United States Patent [19]

Cunningham

[11] 4,093,525

[45] June 6, 1978

[54] METHOD OF PREVENTING HYDROGEN DETERIORATION IN A BIPOLAR ELECTROLYZER

[75] Inventor: Hugh Cunningham, Corpus Christi, Tex.

[73] Assignee: PPG Industries, Inc., Pittsburgh, Pa.

[21] Appl. No.: 716,311

[22] Filed: Aug. 20, 1976

[51] Int. Cl.[2] ..... C25B 1/16; C25B 1/26; C25B 9/02

[52] U.S. Cl. ..... 204/98; 204/128; 204/253; 204/256; 204/289

[58] Field of Search ..... 204/252, 253, 254, 255, 204/256, 257, 280, 286, 288, 98, 128, 289

[56] References Cited

U.S. PATENT DOCUMENTS

| | | | |
|---|---|---|---|
| 3,755,105 | 8/1973 | Messner | 204/256 X |
| 3,809,630 | 5/1974 | DeNora et al. | 204/256 X |

*Primary Examiner*—Arthur C. Prescott
*Attorney, Agent, or Firm*—Richard M. Goldman

[57] ABSTRACT

Disclosed is a method of conducting electrolysis in a bipolar electrolyzer. According to the disclosed method an electrical current is passed from anodes of a first electrolytic cell through an electrolyte to cathodes of the first electrolytic cell, evolving hydrogen at the cathodes. The electrical current then passes from the cathode of the cell through a bipolar unit to the anodes of a subsequent cell in the electrolyzer. The disclosed method is characterized in that the electrical current passes from the cathodes of the first cell through the bipolar unit to the anodes of the subsequent cell by first changing direction and passing laterally through a cathodic element of the backplate to conductor means between the cells, thereafter changing direction and passing through the conductor means, and then changing direction and passing laterally through the anodic element of the backplate to the anodes of the subsequent cell. Also disclosed is a bipolar electrolyzer containing a plurality of individual electrolytic cells electrically and mechanically in series. Each of the cells have anodes and cathodes, with the cathodes of one cell being separated from the anodes of the next adjacent cell in the electrolyzer by a backplate. The electrolyzer is characterized in that the backplate has separate anodic and cathodic members with the anodic and cathodic members being spaced from each other, and conductor means which are offset from both the anodes and the cathodes of the cell. In this way the electrical current changes direction four times, i.e., the electrical current must pass from the cathodes of the first cell laterally thereto, to conductor means and then from the conductor means, laterally thereto, to the anodes of the subsequent cell in the electrolyzer.

2 Claims, 8 Drawing Figures

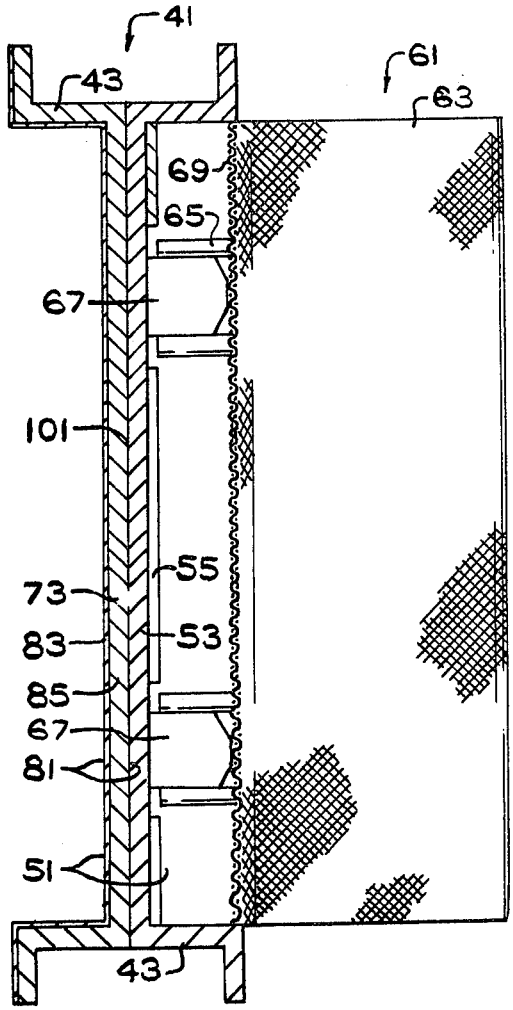
FIG. 4
FIG. 3
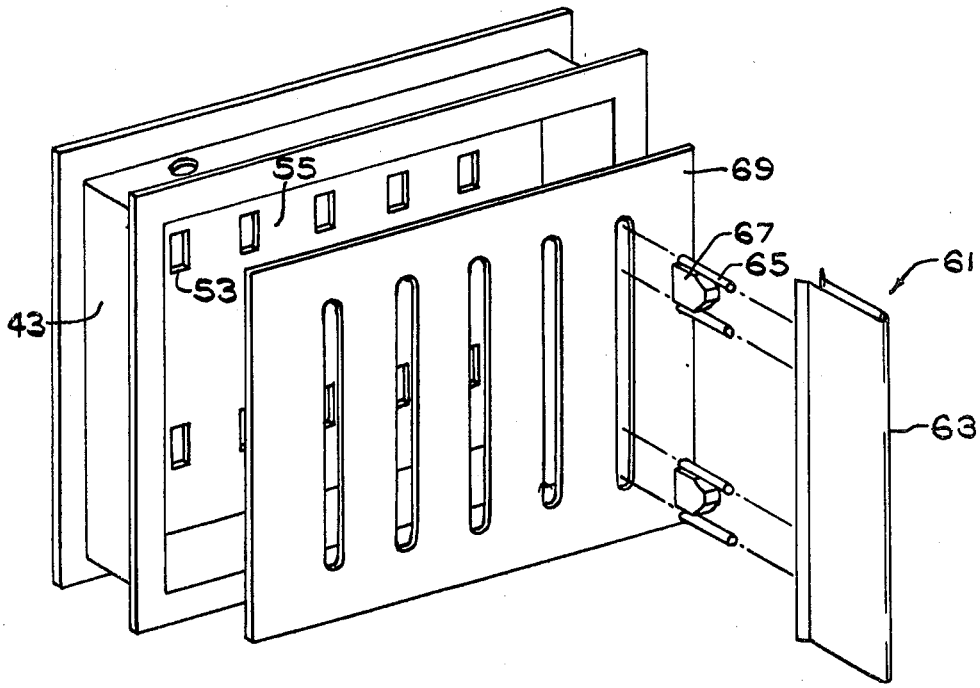

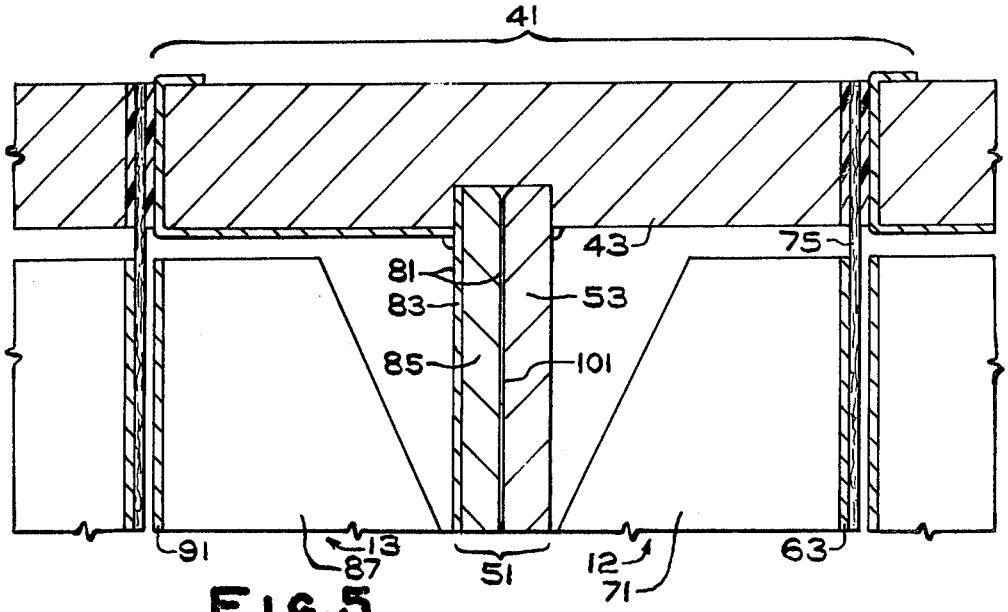
FIG.5
FIG.6
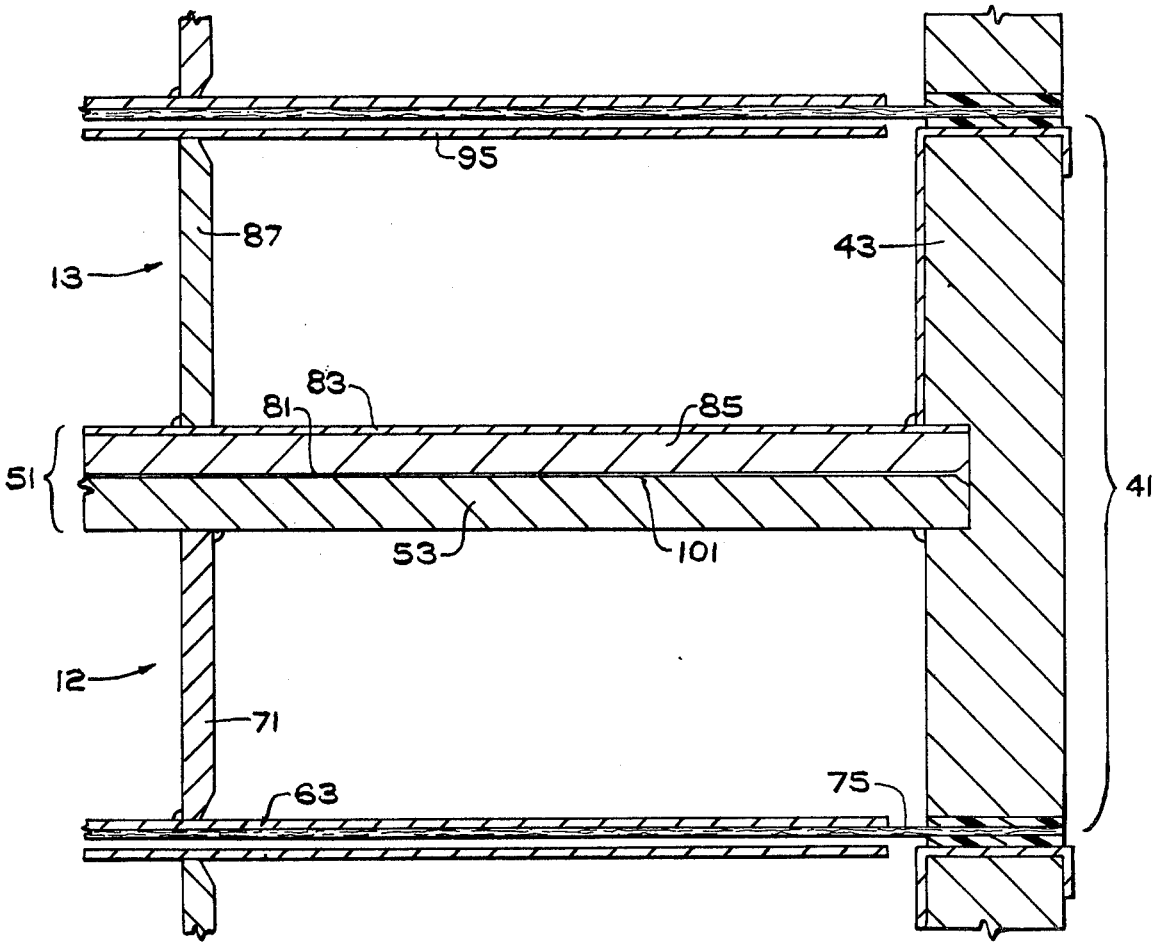

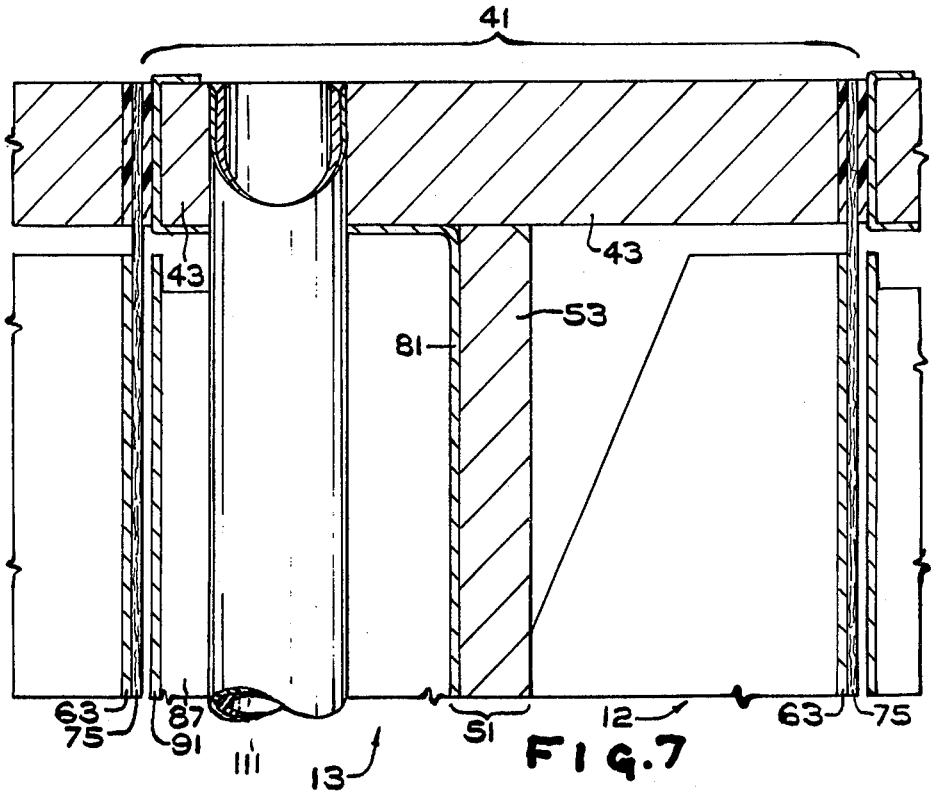
FIG. 7
FIG. 8
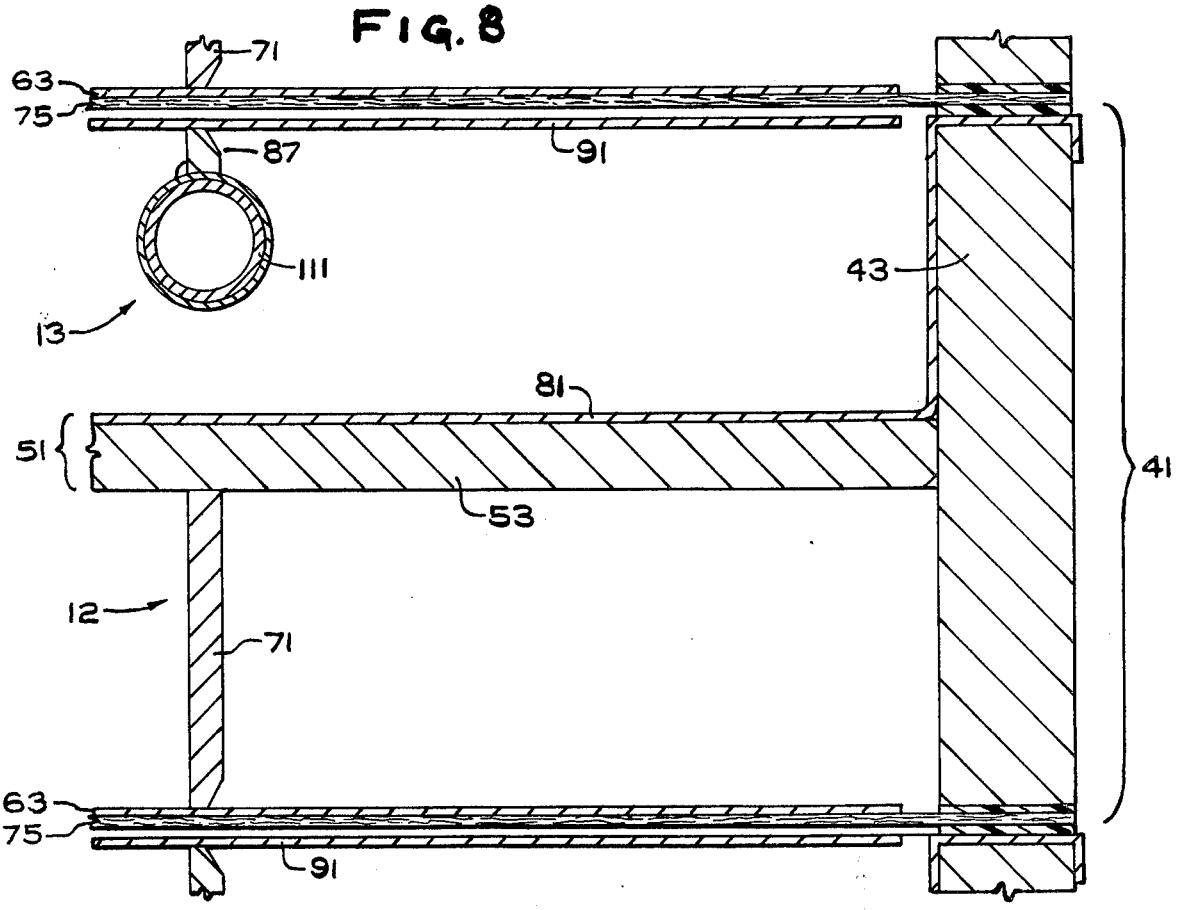

METHOD OF PREVENTING HYDROGEN DETERIORATION IN A BIPOLAR ELECTROLYZER

DESCRIPTION OF THE INVENTION

Alkali metal hydroxide, hydrogen, and chlorine may be produced in diaphragm cells, including permionic membrane equipped cells. In such cells there are two electrolyte compartments. One compartment is the catholyte compartment. The other compartment is the anolyte compartment. The two compartments are separated by a barrier, for example an electrolyte permeable diaphragm of asbestos, or an electrolyte impermeable but ion permeable barrier, for example, a permionic membrane.

Such cells may be electrically connected in series in a common housing with the anodes of one cell being electrically in series with the cathodes of the prior cell and mounted on the opposite sides of a common structural member. In this way the cathodes of one cell are in series with the anodes of the next adjacent cell in the electrolyzer and mounted on a common structural member, and the anodes of the cell are in series with the cathodes of the prior cell in the electrolyzer. Such a configuration is called a bipolar configuration.

An electrolyzer is an assembly of electrolytic cells in bipolar configuration. The common structural member is called a bipolar unit or bipolar electrode. The common structural member includes the backplate, the anodes of one cell in the electrolyzer and the cathodes of the next adjacent cell in the electrolyzer connected thereto. The electrolytic cell provided by the anodes of one bipolar electrode facing the cathodes of the adjacent bipolar electrode and facing each other so that electrolysis of electrolyte may be carried out therebetween is called a bipolar cell.

Bipolar electrolyzers are described in the article by Kircher, "Electrolysis of Brines in Diaphragm Cells," in Sconce, Chlorine, Reinholt Publishing Corp., New York, N.Y. (1962).

Bipolar electrolyzers provide economy of materials of construction and plant space. However, in order to take advantage of the apparent economies of bipolar electrolyzers, electrolysis should be conducted at high current densities, for example above about 120 Amperes per square foot or even above about 190 Amperes per square foot. When electrolysis is carried out at such current densities it is important that the electrical current flow through the electrolyzer with minimun electrical resistance between adjacent cells in the electrolyzer. It is also important that the seepage of electrolyte into the backplates be completely prevented.

In early bipolar electrolyzers, the flow of electricity through the backplate was enhanced by providing metal to metal contact between the titanium of the anolyte surface of the backplate and the steel of the catholyte resistant surface of the backplate, for example as in explosion bonded backplates. In other bipolar electrolyzer designs, electrically conductive structures in the backplate carried the current from the cathodes through the backplate to the anodes connected thereto. One way this was accomplished was by the use of copper studs which extended through the backplate.

However, it was soon found that in bipolar electrolyzers having steel-titanium laminate backplates the atomic hydrogen generated on the steel cathodic surface of the backplate migrated through the steel toward the titanium member of the backplate. This resulted in the formation of titanium hydride at the interface between the steel and the titanium. One solution of this problem is shown in U.S. Pat No. 3,759,813 to Carl W. Raetzsch et al for an "Electrolytic Cell" and U.S. Pat. No. 3,849,280 to Carl W. Raetzsch et al for "Electrolytic Cell Including Means for Preventing Atomic Hydrogen Attack of the Titanium Backplate Member." As described therein means are provided in combination with the cathodic surface of the backplate to prevent the entrance of hydrogen into the steel or alternatively to vent the hydrogen from between the steel and the titanium.

It has now been found that if the flow of electrical current through the backplate can be caused to be lateral, i.e., perpendicular, to the overall flow of electrical current from the first anodic half cell of the electrolyzer, the hydrogen diffusion toward and into the titanium may be substantially reduced. The formation of titanium hydride is further diminished if the anodic member of the backplate is spaced from the cathodic member of the backplate and the conducting means are at the periphery of the backplate.

According to the method of this invention this may be accomplished by passing the electrical current from the cathodes of the first cell of a pair of cells through the backplate toward the conductor means in a direction lateral to the overall flow of current through the electrolyzer, thereafter passing the electrical current through the conductor means, and then passing the current through the backplate to the anodes laterally to the direction of the overall flow of current. This may be carried out in a bipolar electrolyzer where the backplate has an anodic member and a separate cathodic member, with conductor means offset from the anodes and cathodes so that electrical current passes from the cathodes of the first cell laterally to the direction of the overall flow of electrical current through the cell, to conductor means, through the conductor means, and then, laterally to the direction of the overall flow of current, to the anodes of the subsequent cell.

DESCRIPTION OF THE DRAWINGS

FIG. 3 is an exploded perspective view, toward the cathodes, of an individual cell of the electrolyzer shown in FIG. 1.

FIG. 4 is a cut away side elevation of a bipolar unit of the electrolyzer shown in FIGS. 1, 2, and 3.

FIG. 5 is a cut away elevation view of a backplate of an alternative exemplification wherein the anodic and cathodic elements are joined at the peripheral wall of the electrolyzer.

FIG. 6 is a cut away plan view of the exemplification shown in FIG. 5 wherein the anodic and cathodic elements are joined at the peripheral wall.

FIGS. 7 and 8 are cut away elevation views of a bipolar unit of still another exemplification of the structure of this invention wherein the current flows from an electrode through means joined to the peripheral directly to the peripheral walls and thence to the backplate and the next adjacent electrode.

DETAILED DESCRIPTION OF THE INVENTION

Figure 1:
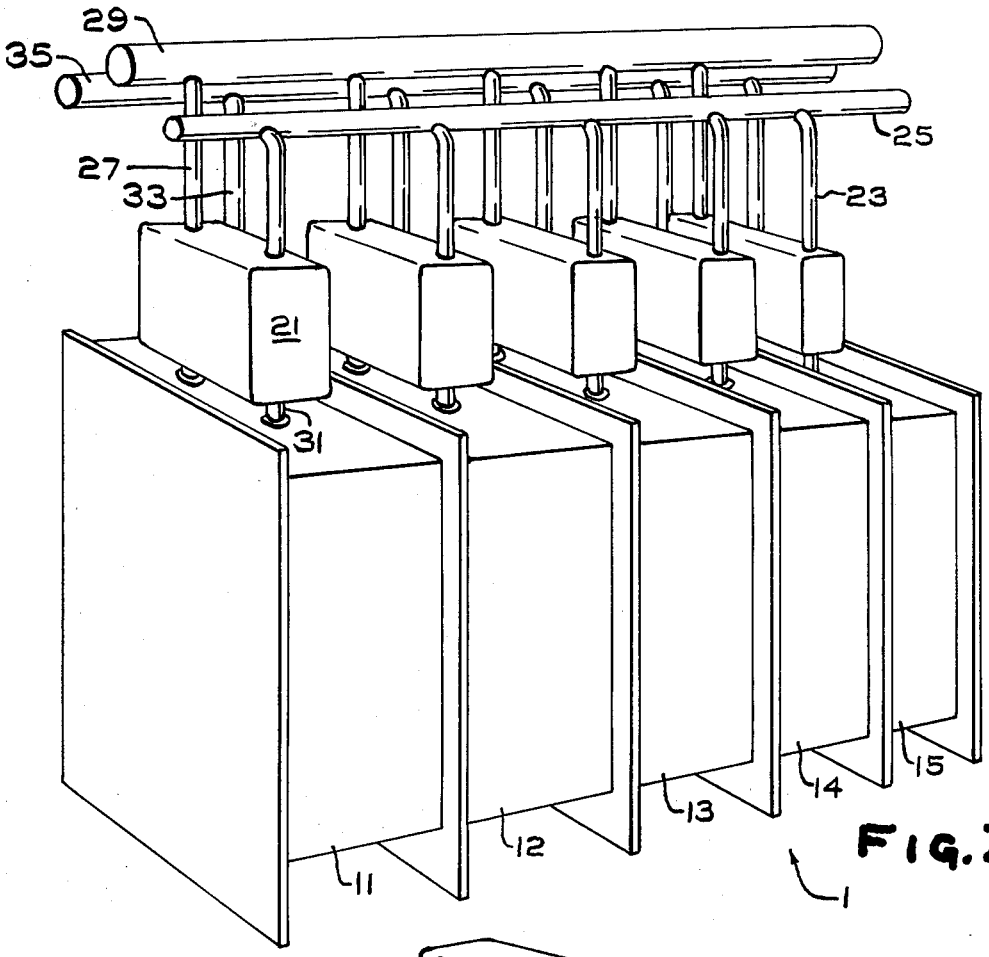
FIG. 1 is a perspective view of a portion of a bipolar electrolyzer.
Figure 2:
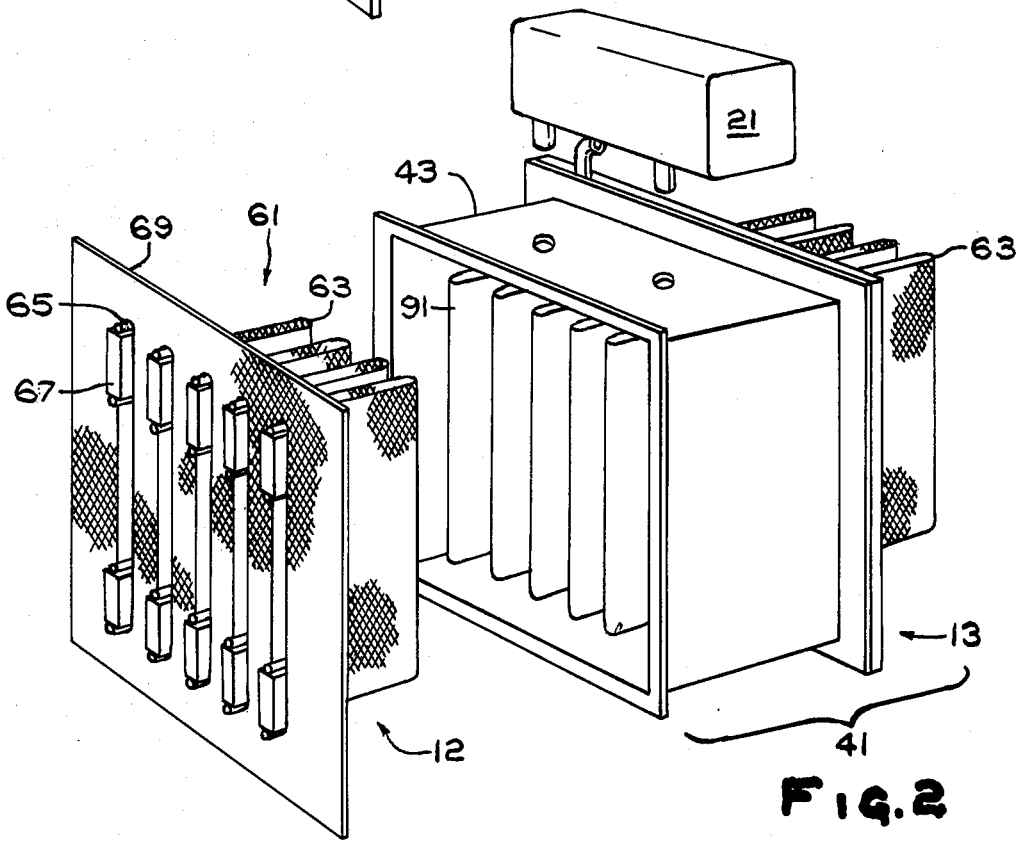
FIG. 2 is an exploded perspective view, toward the anodes, of an individual cell of the electrolyzer shown in FIG. 1.

A bipolar electrolyzer 1 is shown in FIG. 1 and an individual cell thereof is shown in FIGS. 2 and 3. The bipolar electrolyzer 1 has a plurality of individual electrolytic cells 11 through 15 electrically and mechanically in series, with an anodic end cell 11 at one end of the electrolyzer 1 and a cathodic end cell 15 at the opposite end of the electrolyzer 1. Intermediate cells 12 through 14 are between the anodic end cell 11 and the cathodic cell 15 of the electrolyzer 1.

On top of the electrolyzer 1 are the brine tanks 21. Brine is fed from a brine header 25 through brine lines 23 to the brine tanks 21 and from the brine tanks 21 to the individual electrolytic cells 11 through 15. The brine tanks 21 also receive chlorine gas from the individual cells 11 through 15 through lines 31 to the brine tank and discharge chlorine from the brine tank 21 through chlorine lines 27 to the chlorine header 29.

Hydrogen is recoverd from the individual cells 11 through 15 through hydrogen lines 33 that lead to the hydrogen header 35. Liquid catholyte product, for example a cell liquor of potassium chloride and potassium hydroxide in a diaphragm cell having a potassium chloride feed, or a cell liquor of sodium chloride and sodium hydroxide in a diaphragm cell having sodium chloride feed, or sodium hydroxide in a permionic membrane equipped cell having sodium chloride feed, is recovered from the cells through catholyte recovery means, i.e., cell liquor perc pipes. The effluent of the cell liquor perc pipes is collected in a cell liquor trough.

In the operation of a bipolar electrolyzer an electrical current passes from the anodes of the first electrolytic cell through electrolyte to cathodes of the first electrolytic cell, evolving chlorine on the anodes, hydrogen on the cathodes, and alkali metal hydroxide in the catholyte liquor. The electrical current then passes from the cathode of one cell to the anodes of the next adjacent cell in the electrolyzer.

According to the method of this invention the electrical current typically will undergo four changes of direction. First, the current will change direction from the direction of the overall resultant flow of current from the one cell to the next, i.e., the vector flow of current, to a direction lateral thereto. Second, when the electrical current encounters a conductor means, as will be described more fully hereinafter, the direction of flow of the current will generally be in the parallel to the vector flow. Third, as the current passes from the conductor through the anodic element of the backplate, the current will again change direction to a direction lateral to the vector flow of current. Fourth, as the current enters the anode of the next adjacent cell in the electrolyzer, it will return to the direction of the vector flow of current. In this way an indirect path is provided for the electrical current.

By the vector direction of flow of current is meant the direction of flow of current from the anodic half unit at one end of the electrolyzer to the cathodic half unit at the opposite end of the electrolyzer.

The change in direction from the cathode through the cathodic element of the backplate to the conductor may be accomplished by passing the current laterally through the cathodic element of the backplate to a peripheral conductor. Alternatively it may be accomplished by offset conductor means that pass through the cathodic element of the backplate to the anodic element of the backplate. While flowing through the cathodic element of the backplate the current is flowing laterally to the vector direction of the current flow.

The direction of the flow of the current through the conductor means will generally be in the vector direction of flow of electrical current through the cell. This may be accomplished by causing the current to pass through either peripheral walls of the electrolyzer to the anodic element of the backplate, or through offset conductor means within the cell body to the anodic element.

When the current leaves the conductor, it is caused to flow to the anodes of the next adjacent cell laterally to the vector direction of the current flow.

According to a further exemplification of this invention the conductor may be in the periphery of the cell body and the current may be caused to pass directly from the periphery of the cell body through anode supports to the anode. Such supports may be cell peripheral wall to cell peripheral wall members to which the anodes are joined.

According to a further exemplification of this invention current may be caused to pass from the cathodes through means electrically joining the cathode and cathode backscreen directly to the peripheral walls of the cell and thence from the peripheral walls of the cell laterally through the anodic element of the backplate to the anodes of the next adjacent cell in the electrolyzer.

The backplate 51 has anodic 81 and cathodic 53 elements. According to this invention the anodic 81 and cathodic 53 elements of the backplate 51 are electrically insulated from each other over a major portion of their respective areas. That is, they may be spaced from each other with only limited areas of electrical contact therebetween. Typically reverse sites of the portions of the elements exposed to electrolyte may be spaced from each other, or the reverse sides of the electrode bearing portions of the backplate elements may be spaced from each other. The electrical contact may then be provided by offset conductors, either within the backplate or at the peripheral walls of the electrolyzer.

the backplate 51 includes conductor means offset from the anodes 61 and cathodes 91. This is so that the current first flows laterally to the overall vector flow of current through the electrolyzer, then parallel to the overall vector flow of current through the electrolyzer, and finally laterally to the overall vector flow of current through the electrolyzer, back to the cathode.

One structure useful in carrying out the method of this invention is illustrated in FIGS. 2, 3, and 4. As there shown a bipolar unit 41 has the cathodes 61 of the prior cell 12 of the electrolyzer 1, the anodes 91 of the subsequent cell 13 of the electrolyzer 1 and a peripheral wall 43. Also shown are the cathodes 61 of the subsequent cell 13 in the electrolyzer 1.

The anodic element 81 of the bipolar unit includes a steel member 85 and a titanium member 83. The two members 85 and 83 may be explosively bonded to each other. The cathodic element 53 includes a steel member 53 and a compressive member 55 joined to the steel member 53 by a welded joint 73. The cathodes 61 include cathode fingers 63, cathode bases 67, cathode studs 65, and a cathodic backscreen 69.

The compressive means 55, i.e., a plate or sheet, is welded to the steel surface 85 of the anodic unit 81, in this way holding the cathodic unit 51 to the steel surface 85 of the anodic unit 81. As shown in the exemplification in FIGS. 2, 3, and 4 the electrical current passes from the cathodes 63 through the studs 65 to the cathodic member 53 of the backplate 51 where its direction is changed to a direction lateral to the overall vector flow of current through the electrolyzer 1. The hydrogen, however, diffuses through the cathodic member 53 to a void between cathodic member 53 and anodic member 85, where it vents to the atmosphere. The current then flows through the cathodic portion 53 of the backplate 51 to the welded joint 73. Thereafter the current flows through the joint 73 in a direction parallel to the overall vector flow of current, thence laterally to the direction of overall vector flow of current through the anodic element 81 of the backplate 51 to the anodes 91.

An alternative exemplification of this invention is shown in FIGS. 5 and 6. As there shown the bipolar unit 41 has an anode 91 spaced from the anodic element 81 of the backplate 51 on a support 87, and a cathode 63 spaced from the cathodic element 53 of the backplate 51 on a support 71. The cathode 63 may have diaphragm or membrane 75 thereon.

The backplate 57 includes an anodic member 81 of either steel 85 and titanium 83 with the titanium 83 exposed to the anolyte or, in an alternative exemplification, only titanium. The bipolar unit 41 further includes a peripheral wall 43. Electrical current passes from cathode 63 through the support 71 to the cathodic unit 53, laterally to the peripheral wall 43, through the peripheral wall 43 as a conductor displaced or offset from the anodes 91 and cathodes 63 to the anodic element 81 of the backplate 51, thence laterally through the anodic element 81 of the backplate 51 to the anode support 87, and then to the anodes 81. Thus according to the exemplification shown in FIGS. 5 and 6 the conductor means is the peripheral wall 43 of the electrolytic cell. There may, additionally, be an insulating barrier 101 between the anodic member 81 and the cathodic member 53 of the backplate 51.

According to a still further exemplification of this invention, shown in FIGS. 7 and 8, the electrode support may be spaced from the backplate 51, extending from one peripheral wall 43 to the opposite peripheral wall 43. As shown in FIGS. 7 and 8, the bipolar unit 41 includes an anode 91 and a cathode 63 separated by an iron-titanium backplate 57 and surrounded by a peripheral wall 43. The cathode 63 is supported by a support member 71 extending outwardly from the backplate 51 while the anode 91 depends from a conductive support 111 spaced from the backplate 51 and extending from the peripheral wall 43 to opposite peripheral wall 43. In the exemplification shown in FIGS. 7 and 8 a valve metal clad conductor 111, e.g., a titanium clad copper member, extends from the top 43 of the cell to the bottom, with a member 87 extending therefrom and supporting the anode 91. In the exemplification shown in FIGS. 7 and 8 electrical current flows from the cathode 63 of a cell 12 to the backplate 51, thence in a direction lateral to the overall vector flow to the peripheral wall 43, and through the peripheral wall 43 to the conductive support 111 thence through the conductive support 111 to the anode 91 of the next adjacent cell 13 in the electrolyzer 1.

According to this invention the anodic and cathodic of the elements of the backplate are electrically insulated from each other of a major portion of their respective surfaces, e.g., 99 percent or more. They may, additionally be physically separated from each other. For example, an electrically insulating barrier such as a ceramic, or a polymer, for example polymer film with high enough breakdown potential to withstand a 0.2 to 0.5 volt potential over a period of several years, may be provided between the anodic element and cathodic element of the backplate.

While the invention has been described with reference to particular exemplifications and embodiments thereof, it is not intended to so limit the scope of the invention except as insofar as specific details as recited in the appended claims.

I claim:

1. In a method of conducting electrolysis in a bipolar electrolyzer having a plurality of electrolytic cells electrically and mechanically in series comprising passing an electrical current from an anodic end of said electrolyzer to anodes of a first electrolytic cell through an aqueous alkali metal chloride anolyte and an aqueous alkali metal hydroxide containing catholyte to cathodes of said first electrolytic cell, evolving hydrogen at said cathodes, and passing said electrical current from said cathodes through a bipolar unit to which said cathodes are joined to anodes of a subsequent cell in said electrolyzer, said anodes joined to the opposite side of said bipolar unit, and thereafter to a cathodic end of said electrolyzer, the improvement comprising:

passing said electrical current from the cathodes of the first cell laterally to the overall vector flow of current through the electrolyzer, from an anodic end of said electrolyzer to a cathodic end of said electrolyzer, to conductor means at the periphery of said cell; and passing said electrical current through said conductor means parallel to the vector flow of current through the electrolyzer and then in a direction laterally to the vector flow of current through the electrolyzer from the conductor means to the anodes of the subsequent cell.

2. In a method of conducting electrolysis in a bipolar electrolyzer having a plurality of individual electrolytic cells electrically and mechanically in series comprising passing an electrical current from an anodic end of said electrolyzer to anodes of a first electrolytic cell through an aqueous alkali metal chloride and an aqueous alkali metal hydroxide containing catholyte to cathodes of said first electrolytic cell, evolving hydrogen at said cathodes, and passing said electrical current from said cathodes through a backplate of said electrolyzer to anodes of a subsequent cell on the opposite side of said backplate in said electrolyzer, and thereafter to a cathodic end of said electrolyzer, the improvement comprising:

passing said electrical current from the cathodes of first cell to a cathodic conductor of the backplate and laterally to the overall vector flow of current through the electrolyzer from said anodic end unit to said cathodic end unit, through said cathodic conductor to peripheral conductor means at the periphery of said backplate; and passing said electrical current through said peripheral conductor means parallel to the overall vector flow of current through said electrolyzer from said anodic end to said cathodic end of the electrolyzer, to an anodic conductor of the backplate and then from said conductor means laterally to the overall vector flow of current through the electrolyzer through said anodic conductor to the anodes of the subsequent cell.

* * * * *